US007543821B2

(12) United States Patent
Winningham et al.

(10) Patent No.: US 7,543,821 B2
(45) Date of Patent: Jun. 9, 2009

(54) BALL RETURNER FOR USE WITH A GOAL

(75) Inventors: Matthew Winningham, Royal Oak, MI (US); Craig Herman, Pleasant Ridge, MI (US)

(73) Assignee: Warrior Sports, Inc., Warren, MI (US)

( * ) Notice: Subject to any disclaimer, the term of this patent is extended or adjusted under 35 U.S.C. 154(b) by 0 days.

(21) Appl. No.: 11/841,331

(22) Filed: Aug. 20, 2007

(65) Prior Publication Data

US 2008/0096695 A1 Apr. 24, 2008

Related U.S. Application Data

(60) Provisional application No. 60/822,844, filed on Aug. 18, 2006.

(51) Int. Cl.
*A63B 69/00* (2006.01)

(52) U.S. Cl. ..... 273/396; 473/435; 473/478; 273/400

(58) Field of Classification Search ..... 273/398–402, 273/394–397; 473/476, 478, 434, 435, 454, 473/456, 150; 482/27–29
See application file for complete search history.

(56) References Cited

U.S. PATENT DOCUMENTS

| | | | | |
|---|---|---|---|---|
| 715,249 | A * | 12/1902 | Dunbar | 273/401 |
| 1,540,670 | A * | 6/1925 | Vidmer | 473/190 |
| 3,368,814 | A * | 2/1968 | Kolwicz | 273/342 |
| 3,502,330 | A * | 3/1970 | Cheftel | 273/395 |
| 5,413,340 | A * | 5/1995 | Potvin et al. | 273/127 B |
| 5,823,885 | A * | 10/1998 | Stempfer | 473/197 |
| 5,967,911 | A * | 10/1999 | McAvoy | 473/435 |
| 6,165,085 | A * | 12/2000 | Lubin | 473/478 |
| 6,319,145 | B1 * | 11/2001 | Coughlan | 473/197 |
| 6,739,988 | B2 | 5/2004 | Jensen et al. | |
| 6,749,520 | B1 * | 6/2004 | Neskudla et al. | 473/197 |
| 2003/0224866 | A1 * | 12/2003 | Chen | 473/197 |
| 2005/0209053 | A1 * | 9/2005 | Knox | 482/27 |
| 2006/0091610 | A1 * | 5/2006 | Williams | 273/398 |

OTHER PUBLICATIONS

STX Equipment Apparel Catalog, 2006, pp. 50-51.
Great Atlantic Lacrosse Company Catalog, Oct. 2002, p. 49.
Great Atlantic Lacrosse Company Catalog, Holiday 2003, p. 39.
Great Atlantic Lacrosse Company Catalog, Spring 2006, p. 45.
Brine Lacrosse Dealer Catalog, 2005, p. 37.

* cited by examiner

*Primary Examiner*—Mark S Graham
(74) *Attorney, Agent, or Firm*—Warner Norcross & Judd LLP

(57) ABSTRACT

A ball returner for a sports goal includes a triangular frame substantially framing an elastic material, which may be taughtly extended there across. The frame may include two or three sides coupled together. Coupled to one corner of the frame is at least one stand portion extending at an angle thereto, such that, when the frame is placed on a flat surface, the corner has a higher elevation than the other two corners. All of the stand portions may be extendable for varying the angle of the corner relative to the flat surface. The ball returner may or may not be coupled to the sports goal and is light-weight and transportable.

6 Claims, 2 Drawing Sheets

BALL RETURNER FOR USE WITH A GOAL

CROSS REFERENCE TO RELATED APPLICATIONS

The present application claims priority from U.S. Provisional Application Ser. No. 60/822,844 filed on Aug. 18, 2006.

TECHNICAL FIELD

The present invention relates generally to an athletic training aid and more specifically to a ball returner for use with a goal.

BACKGROUND OF THE INVENTION

It is a constant objective within the area of athletic training aids to maximize training time and minimize time associated with related training tasks.

Current athletic training aids for lacrosse include goals having targets included thereon and screens or surfaces for deflecting lacrosse balls. However, there is currently no system or method including the important features of a lacrosse goal for receiving a lacrosse ball while also providing a system for deflecting or returning shots from the lacrosse goal to the player without them having to manually retrieve it. Such a system would be highly desired to allow a lacrosse player to efficiently practice passing or shooting a lacrosse ball at a goal while minimizing or eliminating the time necessary to retrieve a lacrosse ball from a goal after it is passed or shot.

It is also highly desirable that such a training aid be easily transportable. It is further desirable that such a training aid be easily coupled to a net or goal prior to use. Similarly, such a training aid should be capable of easy uncoupling from a net after use.

SUMMARY OF THE INVENTION

It is therefore an advantage of the present invention to provide an athletic training system for maximizing training time.

It is also an advantage of the present invention to provide a system for use with a lacrosse goal or any other sport goal for returning balls shot into the goal.

It is another advantage of the present invention to provide a system for use with a lacrosse goal or any other sport goal that is easily transportable.

It is another advantage of the present invention to provide a system for use with a lacrosse goal or any other sport goal that is easily coupled to or decoupled from the sport goal.

In accordance with the above advantages of the present invention, a ball returner for a sports goal is provided. The ball returner includes a triangular frame substantially framing an elastic material, which may be taughtly extended there across. The frame may include two or three sides coupled together. Coupled to one corner of the frame is at least one stand portion extending at an angle thereto, such that, when the frame is placed on a flat surface, the corner has a higher elevation than the other two corners to allow a ball to be deflected outwardly from the goal. All of the stand portions may be extendable for varying the angle of the corner relative to the flat surface. The ball returner may or may not be physically coupled (i.e. attached) to the sports goal and is lightweight and transportable.

These and other features and advantages of the present invention will become apparent from the following detailed description of the preferred embodiments, when viewed in accordance with the accompanying drawings and appended claims.

DETAILED DESCRIPTION OF THE PREFERRED EMBODIMENT

In accordance with the above advantages of the present invention, a ball returner for a lacrosse goal is provided.

Figure 1:
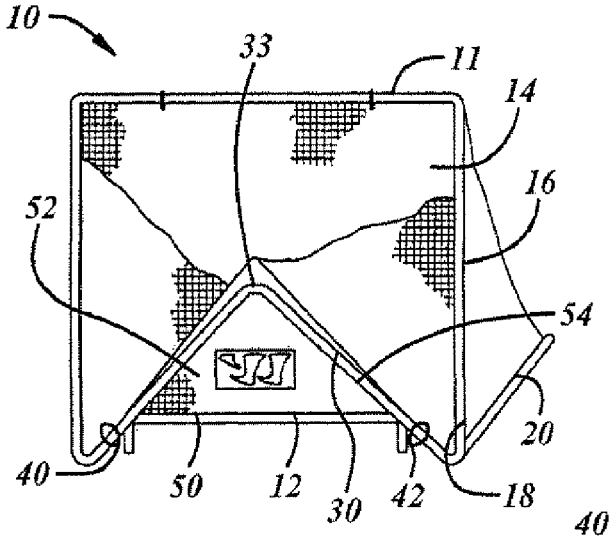
FIG. 1 is a perspective view of a lacrosse goal having a ball returner in accordance with one preferred embodiment of the present invention.

In one embodiment, shown in the attached FIG. 1, a sports goal system, here a lacrosse goal system 10, including a goal 11 and a ball returner 12 is illustrated. The goal 11 includes a net 14 coupled to a frame 16.

The frame 16 includes a substantially square frontal portion 18 and a stand portion 20, such that the net 14 is coupled to the frontal portion 18. The stand portion 20 rests on the ground and stabilizes the frontal portion 18 and extends backwardly therefrom. The net 14 generally couples to the entire frontal portion 18 and extends in a direction of the stand portion 20. In one embodiment, the lacrosse net 14 tapers from the frontal portion 18 to a point rearward of the frontal portion 18 for receiving lacrosse balls therein.

Figure 5:
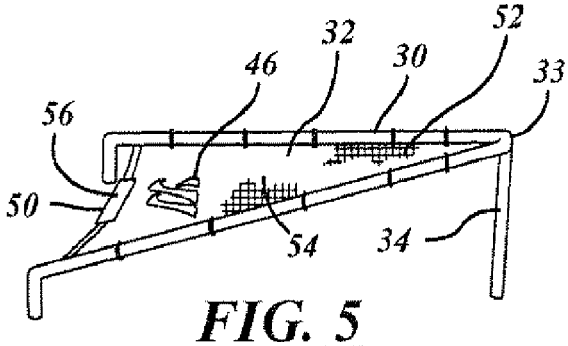
FIG. 5 is a front view of a ball returner in accordance with yet another embodiment of the present invention.

Referring to FIGS. 1, 2, 3, and 4, the ball returner 12 includes a triangular frame 30 substantially framing an elastic material 32, which may be taughtly extended there across. The frame 30 may include two or three sides coupled together. Coupled to one corner 33 of the frame 30 is at least one stand portion 34 extending at an angle thereto, such that, when the frame is placed on a flat surface, the corner 33 has a higher elevation than the other two corners 40, 42. All of the stand portions 34, 40, 42 may be extendable for varying the angle of the corner 33 relative to the flat surface. To illustrate, the stand portion 34 is illustrated larger in FIG. 5 than in FIG. 2.

Figure 3:
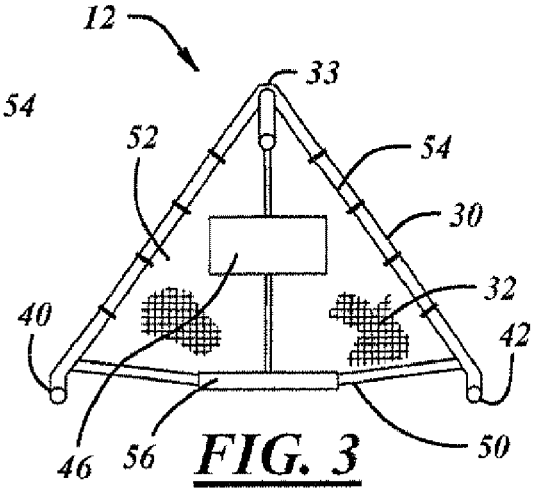
FIG. 3 is a front view of the ball returner of FIG. 2.
Figure 2:
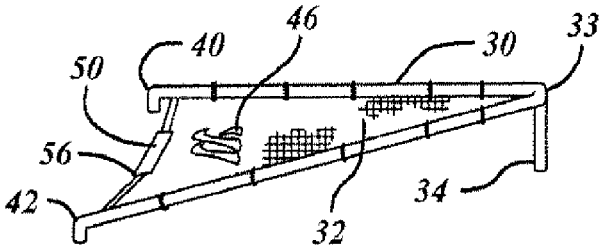
FIG. 2 is a side view of the ball returner of FIG. 1.
Figure 4:
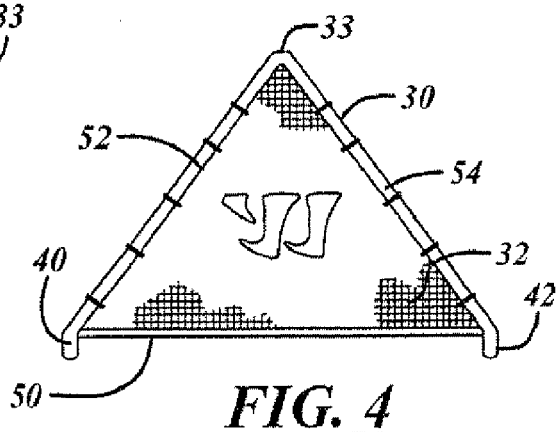
FIG. 4 is a front view of a ball returner in accordance with another embodiment of the present invention.

The elastic material 32 may be uniform (as in FIG. 4) or may include a section 46 having a differing elasticity (as in FIG. 3). The section 46 may be included for strength, such that placement thereof (for example, in a central area of the elastic material 32) is in a high traffic area of the material 32. The section 46 may also function as a target within the ball returner 12 or merely as an area for attaching a logo thereto.

Figure 6:
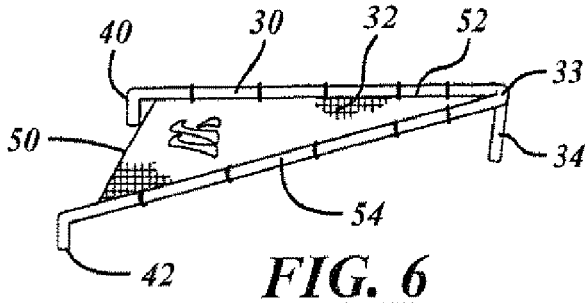
FIG. 6 is a front view of a ball returner in accordance with yet another embodiment of the present invention.
Figure 7:
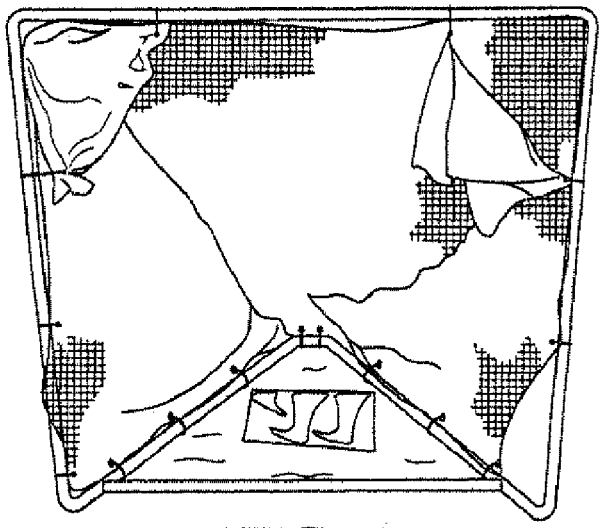
FIGS. 7-12 illustrate copies of photographs of ball returners in accordance with preferred embodiments of the present invention.
Figure 8:
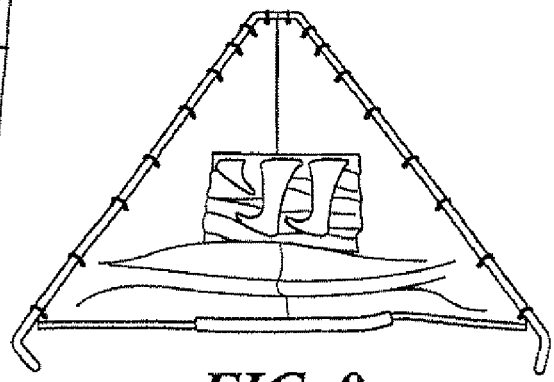
Figure 9:
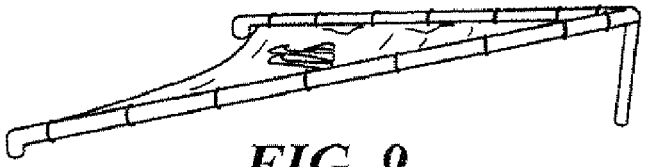
Figure 10:
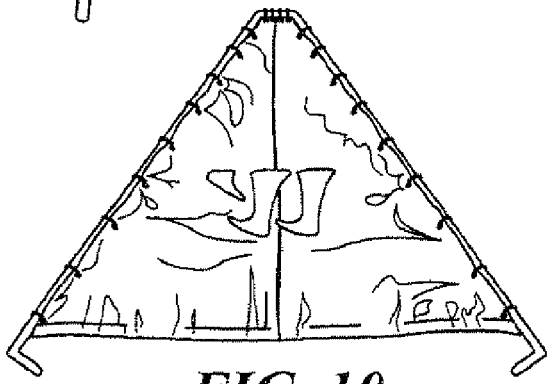
Figure 11:
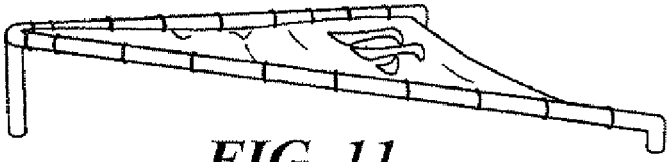
Figure 12:
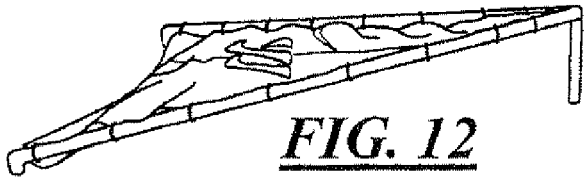

The elastic material 32 includes three edges 50, 52, 54 (first edge 50, second edge 52, and third edge 54). The first edge 50 is closest to the ground and may or may not couple to the frame 30. In other words, if the frame 30 includes only two sides, the first edge 50 will not couple to the frame 30, as in FIG. 6, whereas the second and third edges 52, 54 will. Otherwise, as in FIG. 4, the first edge 50 couples to a frame portion 30. The first edge 50 may be uniform or may include a flange portion 56, such that balls may easily roll off the ball returner 12 as necessary. The flange portion 56 is embodied as a lower portion of the first edge 50, such that the first edge 50 tapers toward the flange portion 56.

The ball returner 12 may or may not couple (or otherwise attach) to the goal 11 and is sized to fit standard lacrosse goals. Important to note is that the ball returner 12 may be square, circular or any other shape useable within a lacrosse goal.

Also, the ball returner 12 may be used for any sport including a goal having a rearward extending net, such as soccer or field hockey. Of course, as one of ordinary skill realizes, the relative size of the ball returner 12 may be increased or decreased to fit accordingly within the particular sports goal for which it is used. Further, the relative elasticity and durability of the elastic material 32, including section 46, may vary from sport to sport, to function in accordance with its intended use.

The ball returner 12 is further illustrated in FIGS. 7-12 in accordance with these preferred embodiments.

While particular embodiments of the invention have been shown and described, numerous variations or alternate embodiments will occur to those skilled in the art. Accordingly, it is intended that the invention be limited only in terms of the appended claims.

What is claimed is:

1. A ball returner for use as a training aid with a sports goal which includes a ground contacting stand portion having first and second base stand portions extending at an angle from one another to form a back corner at the rear of the sports goal, the goal further including a frontal portion that defines a mouth into which a lacrosse ball may be shot or passed, the ball returner being placed on a relatively flat surface within the sports goal during use and providing a system for returning a ball shot or passed within the sports goal, the ball returner comprising:

a frame including a first side and a second side, said first side and said second side being coupled together and defining a first corner therebetween so that the first side and second side cooperate to form a generally triangular shape, the frame being configured to fit at least partially within the stand portion of the sports goal;

an elastic material having a first edge, a second edge and a third edge, said first edge being coupled to said first side, said second edge being coupled to said second side, said third edge being positioned opposite said first corner and adjacent the mouth of the sports goal; and a first stand portion coupled to said first corner and configured for positioning adjacent the back corner of the sports goal, said first stand portion being at an angle relative to said first side and said second side of said frame, the first corner being elevated above the first edge and defining the highest elevation of the ball returner above the relatively flat surface so that the ball shot or passed into the sports goal is urged to roll along the elastic material toward the third edge, and subsequently the mouth of the sports goal under the force of gravity, wherein said elastic material includes a first section having a different elasticity than another portion of said elastic material.

2. The ball returner of claim 1, wherein said first section is located in a central area of said elastic material.

3. A ball returner for use as a training aid with a sports goal which includes a ground contacting stand portion having first and second base stand portions extending at an angle from one another to form a back corner at the rear of the sports goal, the goal further including a frontal portion that defines a mouth into which a lacrosse ball may be shot or passed, the ball returner being placed on a relatively flat surface within the sports goal during use and providing a system for returning a ball shot or passed within the sports goal, the ball returner comprising:

a frame including a first side and a second side, said first side and said second side being coupled together and defining a first corner therebetween so that the first side and second side cooperate to form a generally triangular shape, the frame being configured to fit at least partially within the stand portion of the sports goal;

an elastic material having a first edge, a second edge and a third edge, said first edge being coupled to said first side, said second edge being coupled to said second side, said third edge being positioned opposite said first corner and adjacent the mouth of the sports goal;

a first stand portion coupled to said first corner and configured for positioning adjacent the back corner of the sports goal, said first stand portion being at an angle relative to said first side and said second side of said frame, the first corner being elevated above the first edge and defining the highest elevation of the ball returner above the relatively flat surface so that the ball shot or passed into the sports goal is urged to roll along the elastic material toward the third edge, and subsequently the mouth of the sports goal under the force of gravity, wherein said frame further comprises a third side, wherein said third side is coupled to said second side and defines a second corner therebetween; and wherein a flange portion is coupled within said third side, said flange portion representing a lowest portion of said third edge.

4. The ball returner of claim 3, wherein said flange portion is integrally formed with said third side.

5. A goal system for use on a relatively flat surface, the goal system comprising:

(a) a goal including a net coupled within a frame, the frame including at least two base stand portions joined at an angle with one another at a back corner of the frame, the frame being of a generally triangular configuration, the goal including a frontal portion forming a mouth into which lacrosse balls may be shot or passed, the frontal portion being located distal from said back corner, (b) a ball returner adjacent said flat surface and said net within said frame, said ball returner being at least partially within the goal, said ball returner comprising:

a ball returner frame including a first side and a second side, said first side and said second side being joined together and defining a first corner there between, said first corner being in close proximity to said net of said goal, the first corner being adjacent said back corner of said frame of said goal;

an elastic material having a first edge, a second edge and a third edge, said first edge being coupled to said first side and said second edge being coupled to said second side, said third edge being positioned adjacent the mouth of the goal, the elastic material being at least partially disposed between the at least two base stand portions of the ball returner and at least partially forward of the back corner of the goal; and a first stand portion joined with at least one of said first side and said second side of said ball returner at an angle relative to at least one of said second side and said first side, wherein a topmost part of said first corner defines the highest elevation of the ball returner above the relatively flat surface, wherein the elastic material is disposed at an angle relative to the relatively flat surface so that balls shot or passed into the goal are urged to roll along the elastic material toward the mouth of the goal under the force of gravity, wherein said elastic material includes a first section having a different elasticity than another portion of said elastic material.

6. A goal system for use on a relatively flat surface, the goal system comprising:

(a) a goal including a net coupled within a frame, the frame including at least two base stand portions joined at an angle with one another at a back corner of the frame, the frame being of a generally triangular configuration, the goal including a frontal portion forming a mouth into which lacrosse balls may be shot or passed, the frontal portion being located distal from said back corner, (b) a ball returner adjacent said flat surface and said net within said frame, said ball returner being at least partially within the goal, said ball returner comprising:

a ball returner frame including a first side and a second side, said first side and said second side being joined together and defining a first corner there between, said first corner being in close proximity to said net of said goal, the first corner being adjacent said back corner of said frame of said goal;

an elastic material having a first edge, a second edge and a third edge, said first edge being coupled to said first side and said second edge being coupled to said second side, said third edge being positioned adjacent the mouth of the goal, the elastic material being at least partially disposed between the at least two base stand portions of the ball returner and at least partially forward of the back corner of the goal; and a first stand portion joined with at least one of said first side and said second side of said ball returner at an angle relative to at least one of said second side and said first side, wherein a topmost part of said first corner defines the highest elevation of the ball returner above the relatively flat surface, wherein the elastic material is disposed at an angle relative to the relatively flat surface so that balls shot or passed into the goal are urged to roll along the elastic material toward the mouth of the goal under the force of gravity, wherein said frame further comprises a third side, wherein said third side is coupled to said first side and defines a second corner therebetween; and wherein said third side is coupled to said second side and defines a third corner therebetween, wherein a flange portion is coupled within said third side, said flange portion representing a lowest portion of said third edge.

* * * * *